United States Patent [19]

Fisher et al.

[11] 4,008,761

[45] Feb. 22, 1977

[54] METHOD FOR INDUCTION HEATING OF UNDERGROUND HYDROCARBON DEPOSITS USING A QUASI-TOROIDAL CONDUCTOR ENVELOPE

[76] Inventors: Sidney T. Fisher, 53 Morrison Ave.; Charles B. Fisher, 2850 Hill Park Road, both of Montreal, Quebec, Canada

[22] Filed: Feb. 3, 1976

[21] Appl. No.: 654,747

[52] U.S. Cl. ..... 166/248; 166/60; 219/10.79; 219/278

[51] Int. Cl.[2] ..... E21B 43/24

[58] Field of Search ..... 166/248, 57, 60, 302, 166/50; 219/10.79, 277, 278, 10.57, 10.75

[56] References Cited

UNITED STATES PATENTS

| | | | |
|---|---|---|---|
| 2,472,445 | 6/1949 | Sprong | 166/60 |
| 2,801,090 | 7/1957 | Hoyer et al. | 166/60 X |
| 2,856,296 | 10/1958 | Mann et al. | 219/10.79 |
| 2,859,952 | 11/1958 | LaTour et al. | 219/10.57 |
| 3,440,384 | 4/1969 | Schroeder | 219/10.79 X |

*Primary Examiner*—Stephen J. Novosad
*Attorney, Agent, or Firm*—Barrigar & Oyen

[57] ABSTRACT

A method of heating hydrocarbons in situ in an underground hydrocarbon deposit such as bituminous sands or oil shale. A selected part of the deposit is heated by electrical induction coils arranged in a quasi-toroidal configuration to temperatures high enough to facilitate extraction. The coils are preferably comprised of interrupted rectangular turns. A series of generally concentric quasi-toroidal configurations can be used to heat large volumes. A hexagonal honeycomb array of such configurations can be used to heat deposits underlying very large surface areas.

8 Claims, 7 Drawing Figures

METHOD FOR INDUCTION HEATING OF UNDERGROUND HYDROCARBON DEPOSITS USING A QUASI-TOROIDAL CONDUCTOR ENVELOPE

FIELD TO WHICH THE INVENTION RELATES

The present invention relates to a method of heating in situ a selected portion of an underground deposit of naturally occurring hydrocarbons, such as kerogen entrapped within a deposit of shale or the like, or bituminous sands.

BACKGROUND OF THE INVENTION

In Colorado and other areas of the United States are located what are popularly known as "oil shales" occasionally exposed at the surface of the ground but generally overlaid by overburden to varying depths. Oil in the form of kerogen is entrapped within the shale deposits. For many years efforts have been made to recover the oil, and several processes have been proposed for the purpose. Many proposals have involved first the mining of the shale and then the surface extraction of the oil from the mined shale. The mining techniques and associated extraction techniques have generally involved intolerably high capital investments, energy expenditures, ecological damage, and extraction and refining costs.

The present commercial techniques for extracting bitumen from the bituminous sands of northern Alberta involve strip-mining the sands, conveying the minded sand to surface processing plants, and separating the bitumen from the sand. In one commercial operation, a substantial amount of hot water containing waste contaminants requires to be disposed in a tailings pond. The conventional processing is thus seen to require relatively expensive mining techniques which become increasingly unsuitable as the amount of overburden over the bituminous sand formations increases in depth, and is also seen to involve severe environmental impact in that the strip-mining per se seriously damages the surface and in that the waste liquid ponds further contaminate the surface environment. Furthermore, the bituminous sands underlying the surface plants and facilities and tailings disposal areas and rendered inaccessible for mining.

SUMMARY OF THE INVENTION

The invention is a method of heating in situ of underground hydrocarbons located in an underground hydrocarbon or hydrocarbon-bearing deposit such as oil shale or bituminous sands which comprises the heating by a quasi-toroidal electrical induction coil configuration of a selected portion of the deposit to a selected temperature sufficient to facilitate extraction of at least some of the hydrocarbons located in the selected portion. By "hydrocarbon" is meant one or more of the constituents of naturally-occurring deposits of petroleum, kerogen, lignite, etc. composed of the elements hydrogen and carbon, sometimes with the addition of other elements.

The heating is effected by a quasi-toroidal configuration of conductor turns, preferably interrupted turns of rectangular shape and connected in series or parallel, and located underground so as substantially to encompass the selected portion of the hydrocarbon deposit. The electrical induction heating is intended to be continued for a period of time sufficient to raise the temperature of the contents of the deposit to a level sufficient to enable at least some of the contents of liquefy or vaporize and to permit the vapors or liquids released by the process to be collected from one or more suitable wells.

As mentioned above, the induction heating coil configuration utilized in accordance with the present invention is quasi-toroidal. The following discussion is intended to facilitate a comprehension of the meaning of the term "quasi-toroidal."

A surface of revolution is a surface generated by revolving a plane curve about a fixed line in its plane. The line is called the axis of the surface of revolution.

A conventional torus is a surface of revolution generated by a circle offset from the axis, which circle, when it moves about the axis through 360°, defines the toroidal surface. The section of the torus is the circle which generated it. The inner radius of the torus is the distance between the axis and the nearest point of the circle to the axis, and the outer radius of the torus is the distance between the axis and that point on the circle most remote from the central axis. When a coil of wire is formed having the overall shape of a torus, the coil is said to form a "toroidal conductive envelope," since it envelopes a generally toroidal space.

Toroidal inductor coils are well known in electrical engineering. Conventionally, a continuous coil of wire is formed into a torus thereby forming a toroidal envelope having a circular section. Since the coil is a continuous conductor, it follows that the turns of whch the toroidal coil is formed are series connected. Such a toroidal coil has the desirable property that its electromagnetic field is substantially confined to the interior of the torus.

The present invention is concerned not with true toroidal enevelopes but rather with quasi-toroidal envelopes formed by a plurality of discrete interrupted turns lying at different angles so as to approximately surround the volume lying within the envelope. By "interrupted turn" is meant a turn having a discrete discontinuity small with respect to the length of the turn.

A first distinction between a quasi-toroidal envelope and a toroidal envelope is that the turns of the quasi-toroidal envelope do not necessarily form a complete closed curve as is the case (except for the terminals) in a toroidal envelope, but instead each takes the form of an interrupted turn — i.e. a curve which includes a discontinuity (there must necessarily be an electrical discontinuity in order that an electric current may be passed through the quasi-toroidal envelope from one side of the discontinuity to the other).

A further point of distinction is that a quasi-toroidal envelope need not be a surface of revolution, nor does its section have to approximate a circle. A quasi-toroidal surface includes not only surfaces of revolution formed or approximated by rotation of an interrupted circle about an axis but also any practicable topological equivalent thereof, such as a surface of revolution generated by an interrupted rectangle, or such surface "stretched" generally perpendicular to the axis so that an oblong or slab-shaped surface results. Because of the difficulty of drilling curved tunnels underground, a rectangular turn configuration is preferred, comprising only substantially horizontal and vertical conductive elements. (The "horizontal" conductors may depart from the horizontal to follow the upper and lower boundaries respectively of an oil shale or bituminous sand deposit.)

A characteristic of a quasi-toroidal conductor configuration (and indeed also of a toroidal inductor) is that the electromagnetic field strength is highest near the inner radius of the quasi-torus and therefore the hydrocarbons may be expected to liquefy or vaporize, as the case may be, more quickly at the inner radius than the outer radius. This implies that an increasing current will be required in the quasi-toroidal turns to maintain the field strength sufficient to liquefy or vaporize the hydrocabons lying towards the outer radius of the quasi-torus. Eventually the required current may become intolerable, and in the absence of corrective measures, the operation would have to come to a halt.

It is accordingly further proposed according to the invention that progressive extension of the quasi-toroidal conductor configuration to quasi-toroidal structures of increasing radius be utilized to facilitate extraction of hydrocarbons from large underground volumes. If the conductors are arranged initially in a hexagonal array, the hexagonal array can continue to be maintained as the quasi-toroidal radius is increased up to some convenient maximum radius. Use of the hexagonal configuration, moreover, implies that any area of land can conveniently be sub-divided into a hexagonal gridwork, which would permit convenient extraction of as much of the hydrocarbon as economically possible from the hydrocarbon formations underlying the surface hexagonal grid.

In a preferred embodiment of the invention, a central vertical shaft is excavated from the surface to the bottom of an underground hydrocarbon deposit or some other convenient point within the underground hydrocarbon deposit. Vertical shafts or drill holes are also sunk at locations corresponding generally to the apexes of a hexagon whose center is located generally at the center of the central vertical shaft. From a point within the central shaft located at or near the top of the underground hydrocarbon layer, horizontal tunnels are excavated radially outwardly towards each of the hexagonally located vertical shafts. These horizontal tunnels can be continued to a radius considered to be a suitable maximum for a given grid element.

If a six-turn configuration is to be used, the angle between adjacent horizontal tunnels will be 60°. Six vertial shafts or drill holes are arranged to intersect the horizontal tunnels at equal distances from the central shaft. If the diameter of the central shaft is, say, 2 meters, the first set of vertical shafts spaced outwardly from the tunnel might be arranged at about 7 meters from the central vertical shaft. This would enable the vertical and horizontal conductive elements placed in the central shaft, in the vertical drill holes and in the horizontal tunnels, to encompass an annular quasi-toroidal portion of the deposit lying between the central shaft and the spaced drill holes, and lying between the upper and lower tunnels, which latter as indicated previously are suitably placed respectively at the upper and lower extremities of the hydrocarbon deposit.

Assuming then that the innermost quasi-torus is defined by the 2 meter cental shaft and a hexagonal array of vertical drill holes at about 7 meters from the central shaft, the next step is to arrange a further pattern of drill holes to intersect the continuation of the horizontal tunnels at a further distance from the central shaft. This next set of vertical drill holes can be arranged to be at a relatively greater distance from the central shaft than were the first set of drill holes. The next set of vertical drill holes, for example, might be located at a distance of say 40 meters from the central shaft. If a further set of coils beyond the 40 meter distance is to be provided, the next succeeding set of drill holes might be located at, for example, 200 meters from the central shaft. At that distance from the central shaft, the working of the underground deposit would be expected to take several years.

The reason for the foregoing spacing of vertical drill holes is this. In a toroidal or quasi-toroidal conductor configuration, the electromagnetic field strength is highest near the inner turn extremities and lowest near the outer coil extremities. As a consequence, the hydrocarbons near the inner turn extremities will be liquefied or vaporized first, and liquefaction or vaporization will occur progressively outwardly from the innermost turns to a point at which the further economic recovery of material from the deposit becomes impracticable. As hydrocarbons are extracted from, say, the inner quasi-toroidal envelope region, the current required to maintain the hydrocarbons in a state of liquefaction or a state of vaporization, as the case may be, become increasingly high since the amount of conductive material lying within the electromagnetic field generated by the conductive turns becomes increasingly small. Eventually a point is reached at which the turns become too hot or the current becomes too high to permit any further extraction of hydrocarbon. This point is determined in part by the ratio of the diameter of the inner set of conductor turn segments to the diameter of the outer conductive turn elements. Studies performed on mathematical models indicate that at least for some significant underground hydrocarbon deposits, such as the bituminous sands of Alberta, the ratio of outer envelope radius to inner envelope radius for the quasi-toroidal envelope should never exceed about 10, with a ratio nearer 5 to 1 being preferred. This means that if the radius of the central shaft is substantially the inner radius of the innermost quasi-toroidal envelope, then the innermost quasi-toroidal envelope should have an outer radius of the order of 5 times that of the central shaft. The next adjacent toroidal envelope may have an inner radius of 5 times the central shaft radius and an outer radius 25 times the central shaft radius, and so on progressively outwards until some maximum radius is reached repesenting the economical upper limit for the working of the particular deposit in question.

It will be seen from the foregoing that if as few as six sets of turns are used, the effective electromagnetic field produced by the turns necessarily deviates from the field that would be produced if a much larger number of turns were used to define the envelope. The term "quasi-toroidal" used in the specification is intended to embrace the approximation to a true annular volume or envelope with which the electromagnetic field generated by a relatively small number of conductive turns, usually fewer than twenty and, in many of the examples to be considered, six, permeates.

The progressive heating proposal according to the invention, i.e. the progressive utilization of quasi-toroidal envelopes of increasingly large radii, results in a saving in drilling and in conductor utilization, since at least some of the innermost vertical conductor elements of an outer quasi-toroidal envelope can conveniently be the outer-most vertical conductive elements of the next adjacent inner quasi-toroidal envelope.

Furthermore, the horizontal tunnelling can be relatively easily accomplished at the outset for the entire set of horizontal tunnels, because the horizontal conductive elements of the outer quasi-toroidal envelope, or at least some of them, are conveniently formed in alignment with the horizontal conductive elements of the inner quasi-toroidal envelope, thus enabling the same horizontal tunnelling to be used to place the conductors. (In some circumstances, it may be desirable to increase the number of turns as the outer radius of the quasi-torus increases.)

DETAILED DESCRIPTION WITH REFERENCE TO THE DRAWINGS

Figure 1:
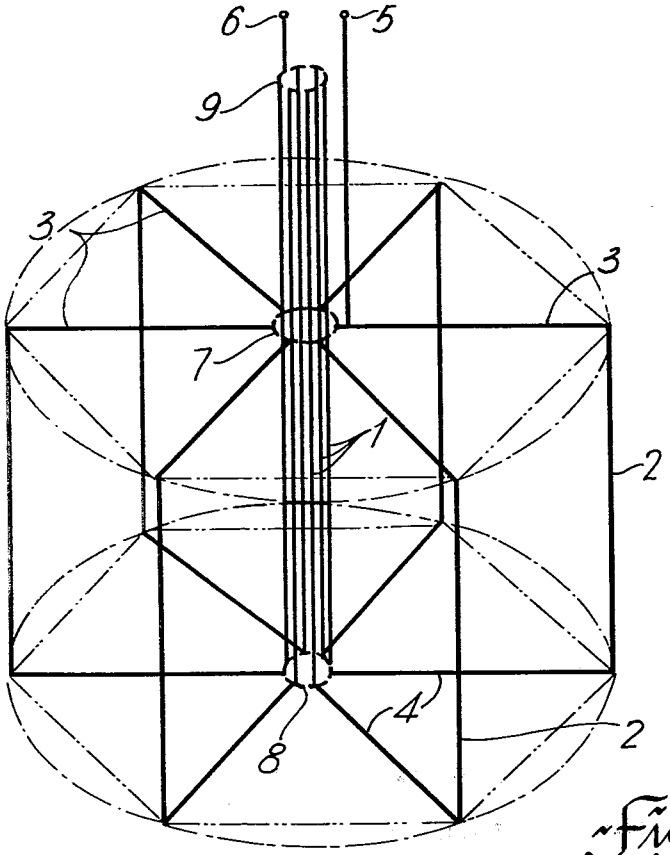
FIG. 1 is a schematic diagram showing the coil structure for a quasi-toroidal envelope for use in accordance with the invention.

FIG. 1 illustrates schematically an embodiment of an inner quasi-toroidal envelope constructed in accordance with the present invention. Within a hydrocarbon deposit, inner vertical conductor segments 1 are connected by upper horizontal conductor segments 3 and lower horizontal conductor segments 4 to outer vertical conductor elements 2. In FIG. 1, by way of example, six turns are illustrated, each turn being composed of two vertical conductor elements 1 and 2 and two horizontal conductor elements 3 and 4 so as to form a substantially rectangular turn. The turns are arranged at angles of 60° to one another to define a generally hexagonal configuration, with the outer vertical conductor elements 2 lying at the apexes of a notional regular hexagon. The inner conductors 1 also lie on the apexes of an inner notional hexagon. By "notional hexagon" is meant that there is no actual structure defining the entire perimeter of the hexagon; only the apexes of the respective hexagons are defined by physical structure.

The upper horizontal conductive elements 3 are shown interconnected by a conductive annular ring 7 to a terminal 5 for connection to one terminal of a source of alternating current (not shown). The inner vertical conductors 1 extend vertically upwards, from their respective points of connection to lower horizontal connectors 4, to an annular connecting conductor 9 which is connected to a terminal 6 for connection to the other terminal of the source of alternating current (not shown). The conductors 1 are insulated from the annular ring 7 and from the upper horizontal conductor elements 3 so that at the inner upper corner of each rectangular turn there is a discontinuity. This of course is essential in order that current flow around the parallel-connected rectangular turns. The term "interrupted turn" is sometimes used herein to indicate that such a discontinuity is present.

When alternating current is applied to terminals 5 and 6, an electromagnetic field is generated by the rectangular coils. The electromagnetic field tends to permeate a quasi-toroidal space which differs from a true toroidal space not only because of the drop-off in field between conductive turns (especially at their outer extremities) but also because of the interrupted rectangular turn configuration in distinction from the usual circular coil configuration which would appear in conventional small-scale toroidal inductors. The quasi-toroidal space has an inner annular radius defined by the radius of the conductive connecting ring 7 (or by the radius of the notional circle on which the junction points of conductors 1 with conductors 4 lie). the outer radius of the quasi-toroidal space is defined by the outer vertical conductor elements 2. The upper limit of the quasi-toroidal space is defined by a notional horizontal annular surface in which the upper conductor elements 3 lie. A similar notional annular surface in which the lower conductor elements 4 lie defines the lower boundary of the quasi-toroidal space. Thus the turns formed by the inner and outer vertical conductor elements 1 and 2 and the upper and lower horizontal conductor elements 3 and 4 together form a quasi-toroidal envelope which substantially surrounds the quasi-toroidal space defined above. Obviously the more turns that are used in the envelope, the more closely the actual electromagnetic field will extend throughout the entire quasi-toroidal space surrounded by the envelope. However, bearing in mind that tunnelling or drilling is required for the introduction of each of the conductor elements into an underground hydrocarbon deposit, a trade-off must be made between the efficiency of generation of the electromagnetic field within the quasi-toroidal space and the economies obtained by minimizing the number of holes or tunnels drilled or excavated. In the discussion which follows it will be assumed that the number turns may be as few as six, which facilitates the formation of a hexagonal honeycomb grid for the extraction of hydrocarbon from an entire hydrocarbon deposit too large to be heated by a single arrangement according to the invention. However, some other number of conductors may be utilized in appropriate situations, and empirical evaluation of the effectiveness of the number of turns initially employed will undoubtedly be made in particular applications to determine whether a greater or fewer number of turns might be suitable. Obviously additional tunnels and drill holes can be provided to increase the number of turns as required.

While in the example of FIG. 1, the upper conductors 3 and the lower conductors 4 have been illustrated as being horizontal, it is to be understood that the orientation of these conductors may vary to accord with the angle of inclination of the upper and lower limits respectively of the underground hydrocarbon deposit required to be heated.

Figure 2:
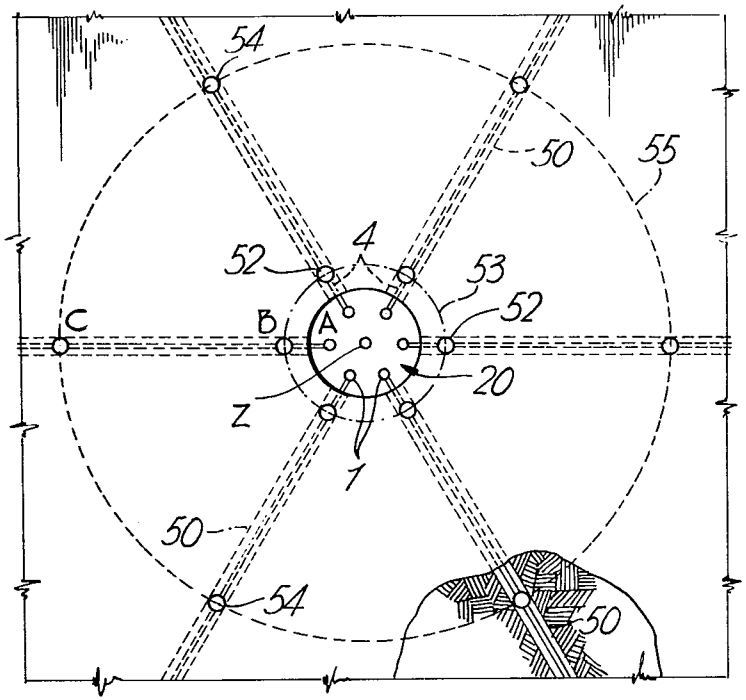
FIG. 2 is a schematic plan view of a portion of the surface of the earth, illustrating a preferred manner of locating vertical drill holes and horizontal tunnels in accordance with the present invention.

For the reasons previously discussed, there is a practical upper limit on the ratio of the outer radius of the quasi-toroidal envelope defined by vertical conductors 2 to the inner radius of the quasi-toroidal envelope defined by the location of the inner vertical conductor elements 1. For this reason it may be desirable to provide a further quasi-toroidal envelope surrounding that illustrated in FIG. 1. Such further quasi-toroidal envelope could utilize as its innermost vertical conductor elements the conductor elements 2 of FIG. 1. FIG. 2 illustrates in plan view the appropriate configuration both of vertical drill holes and horizontal tunnels in which the required coil segments can be located. Obviously only one of the two horizontal tunnels can be shown in plan view; one of any pair of horizontal tunnels of course will generally directly lie below the other horizontal tunnel in the pair.

In a central vertical circular cylindrical shaft 20 the inner vertical conductors 1 are located. Extending radially outwardly from the shaft 20 are horizontal tunnels 50 which we shall assume to be the lower horizontal tunnels required for the location of the lower horizontal conductors 4. The upper horizontal tunnels would then lie directly above tunnels 50. Intersecting with the horizontal tunnels 50 are vertical drill holes 52 in which vertical conductors 2 are located. The conductor arrangement thus defines an inner quasi-toroidal envelope whose outer periphery is generally defined by a notional cylindrical surface shown in plan view by a broken line circle 53 and whose inner periphery is the notional cylindrical surface defined by conductors 1.

The next quasi-toroidal envelope surrounding the inner quasi-toroidal envelope formed by conductors 1, 2, 3 and 4 will then be generated by extending the tunnels 50 radially outwardly from the drill holes 52 and sinking further vertical drill holes 54 which lie again on a notional cylindrical surface indicated in the plan view of FIG. 2 by broken line circle 55. These drill holes 54 thus necessarily lie at the apexes of a further hexagon larger than that defined by the drill holes 52. The inner vertical conductors for the outer quasi-toroidal envelope are conveniently the already-placed vertical conductors 2 located in the drill holes 52. This achieves an economy both in drilling and in conductor utilization. If a further quasi-toroidal space is to be defined, the tunnels 50 can be extended further radially outwardly, a further set of vertical drill holes (not shown) provided, and appropriate extensions of the horizontal conductors and appropriate insertions of additional vertical conductors provided. The inner conductors for such hypothetical outer quasi-toroidal envelope would be the conductors provided in the drill holes 54.

If the center of shaft 20 is indicated by Z, then the inner radius of the inner quasi-toroidal envelope will be AZ where A lies on the circle defined by the inner vertical conductors 1. The outer radius of the inner quasi-toroidal envelope will be BZ, where B lies on the circle defined by vertical conductors 2 located in drill holes 52. The outer next adjacent quasi-toroidal envelope has an inner radius BZ and an outer radius CZ, where C lies on the circle defined by drill holes 54.

Figure 3:
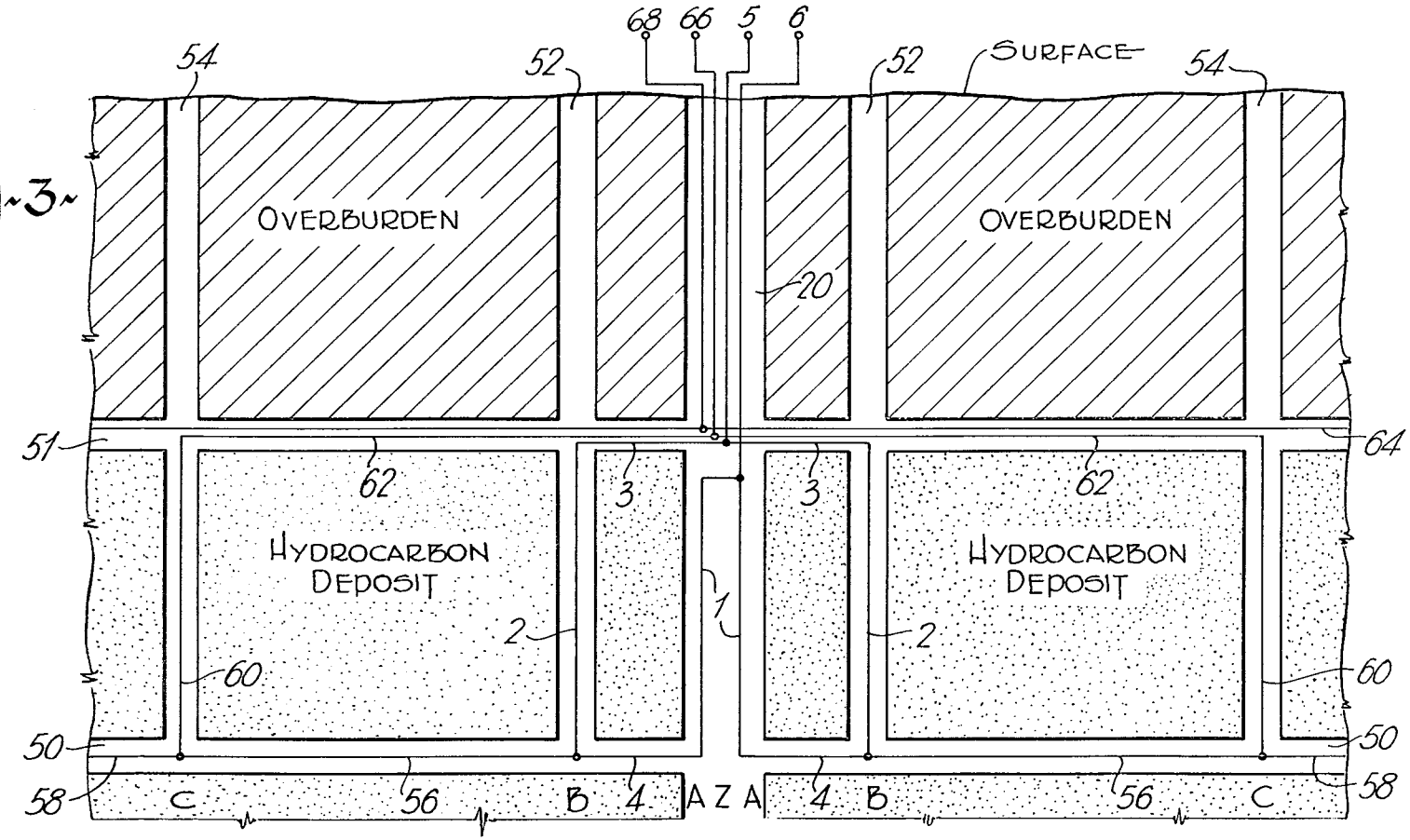
FIG. 3 is a schematic section view of the portion of the earth to which FIG. 2 relates, illustrating a preferred horizontal and vertical tunnel arrangement in accordance with the invention.

A further appreciation of the scheme of FIG. 2 can be had by referring to the schematic elevation view of FIG. 3, which is a section of the earth along one of the horizontal tunnels 50.

Extending radially outwardly from the central shaft 20 are the lower horizontal tunnels 50 located at or near the bottom of a hydrocarbon deposit which is separated from the surface of the earth by an overburden layer. A set of upper horizontal tunnels 51 extend radially outwardly from the central vertical shaft 20 at or near the upper limit of the hydrocarbon deposit. A first set of drill holes 52 define the outer limit of the innermost quasi-toroidal space to be surrounded by the quasi-toroidal conductive envelope. A further set of vertical drill holes 54 spaced radially outwardly from the drill holes 52 define the outer limit of the second quasi-toroidal space. Further vertical drill holes (not shown) could be provided yet further radially outwardly from the shaft 20 to define the outer limit of yet a further quasi-toroidal space.

Conductor elements 1, 2, 3 and 4 are shown connected to surface terminals 5 and 6 for connection to a source of alternating current in the manner previously described with reference to FIG. 1. It can be seen that the inner vertical conductors 1 lie generally along the periphery of the central shaft 20, that the vertical conductors 2 lie in drill holes 52 within the hydrocarbon deposit, that upper horizontal conductors 3 lie in the upper horizontal tunnels 51, and that the lower horizontal conductors 4 lie in lower horizontal tunnels 50.

To provide the rectangular turns required for the adjacent outer quasi-toroidal envelope, tunnels 50 and 51 are shown extending radially outwardly beyond vertical tunnels 52 to intersect an outer set of vertical drill holes 54. Horizontal conductor elements 4 can be continued as horizontal conductor elements 56 lying between drill holes 52 and 54. Vertical conductor elements 60 located in drill holes 54 are connected between horizontal conductor elements 56 and further horizontal conductor elements 62 located in upper horizontal tunnels 51. The interrupted rectangular turns therefore comprise conductor elements 2, 56, 60 and 62 for this quasi-toroidal envelope. The upper horizontal conductor elements 62 are connected to a terminal 66. Alternating current would then be applied across terminals 5 and 66 to energize the intermediate quasi-toroidal envelope.

The horizontal conductors 4, 56, can be further extended as conductor elements 58 to an outer set of vertical drill holes (not shown) in which an outer set of vertical conductors (not shown) may be located. These vertical connectors can then be connected to horizontal conductors 64 located in tunnel extensions 51 which in turn are connected to terminal 68 at the surface. Alternating current can then energize such outer quasi-toroidal envelope by being applied across terminals 66 and 68, it being perceived that the outer toroidal envelope utilizes as its innermost vertical conductors the vertical conductors 60 located in drill holes 54. This kind of progressive drill hole and circuit extension can be continued indefinitely to an outer economic limit.

It is of course necessary in the arrangement above-described to make sure that the conductors 3, 62, 64, etc. located in horizontal tunnel 51 are insulated from one another. The selection of the tunnel 51 as containing a plurality of horizontal conductors whereas the tunnel 50 contains just one continuing horizontal conductor is of course arbitrary; the reverse arrangement might in some circumstances be preferred. Furthermore, it may be preferably in some circumstances to continue the vertical conductors upwardly through drill holes 52, 54, etc. and then to make surface connections from these drill holes rather than via the horizontal tunnels 51. Various alternative conductor configurations which will achieve essentially the same result will occur to those skilled in the art as being convenient and preferable in some situations.

The coil arrangement of FIGS. 1, 2 and 3 has been illustrated as involving a parallel connection between the turns. This is expected to be the most appropriate manner of interconnection of the turns, but a series coil connection could be substituted in a particular situation if considered appropriate by the designer. The manner in which a series connection can be arranged is within the ordinary skill of an electrical engineer.

The size of the tunnels 50 and 51 and the drill holes 52, 54 and of the central shaft 20 have been exaggerated for purposes of convenience of illustration. It is to be expected that these holes will be as small as possible consistent with the use that is to be made of them. The central shaft 20 for example will be utilized not only for the location of the conductors 1 and the connecting lines from terminals 5, 6, 66, 68, etc. but also will probably be required as a construction shaft into which men and machinery will enter for the purpose of excavating horizontal tunnels 50 and 51. The central shaft 20 may also be utilized to extract at least a portion of the hydrocarbon deposit through appropriate conduits. The drill holes 52 and 54 may conceivably be utilized not only for the location of the vertical conductor elements but may also conceivably be utilized for the injection of fluid into the hydrocarbon deposit or the extraction of at least a portion of the hydrocarbons from the deposit. In the event that gas under pressure is required to be injected into the deposit in order to facilitate extraction of hydrocarbons, it may be required to stop-up some of the vertical drill holes 52, 54, etc. to prevent the unwanted escape of gas from the hydrocarbon deposits. Alternatively, the holes might be used to house the gas injection pipes, provided of course that they do not interfere with the induction coils.

Figure 4:
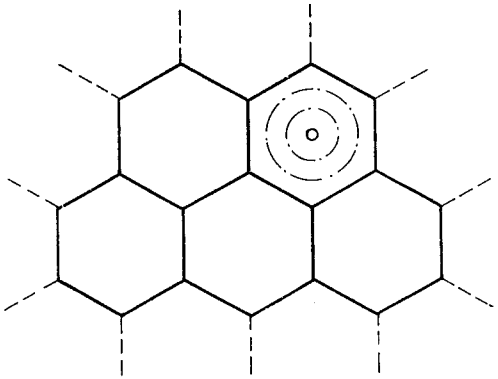
FIG. 4 schematically illustrates a grid arrangement on the earth's surface for the practice of a preferred hydrocarbon exploitation technique according to the invention.

FIG. 4 illustrates a hexagonal honeycomb grid, each hexagonal section thereof comprising a plurality of quasi-toroidal envelopes of the type illustrated in FIG. 2. The number of quasi-toroidal envelopes within any one hexagon will be determined by the economies of the situation, since generally speaking, it is expected that an outer radial limit for the outer periphery of a given quasi-toroidal envelope will be reached beyond which it is uneconomical to arrange further drill holes, tunnels, or conductor elements. However, the hexagonal arrangement of FIG. 4 permits as much of the underground hydrocarbon deposit as economically possible to be effectively exploited. It will be appreciated from the honeycomb arrangement of FIG. 4 that the two outermost drill holes for any one quasi-toroidal configuration can be utilized as the two outermost drill holes for a contiguous quasi-toroidal configuration, thus enabling optimum economic use to be made of the drill holes and the conductors located therein.

Figure 5:
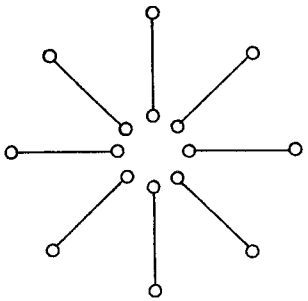
FIG. 5 schematically illustrates an alternative quasi-toroidal drill hole arrangement on the earth's surface in which the number of vertical drill holes and horizontal tunnels is greater than the number illustrated in the preceding figures.

Although six drill holes have been illustrated in FIG. 2 as being required for each succeeding quasi-toroidal stage, it may be desirable to utilize more than six drill holes in some circumstances. Additional drill holes, especially for the outermost quasi-toroidal envelopes, can be provided between those drill holes located at the apexes of the hexagon. Or some other number of drill holes could be utilized in particular situations — for example, FIG. 5 illustrates in plan view a quasi-toroidal arrangement in which eight drill holes, turns, etc. are used.

Figure 6:
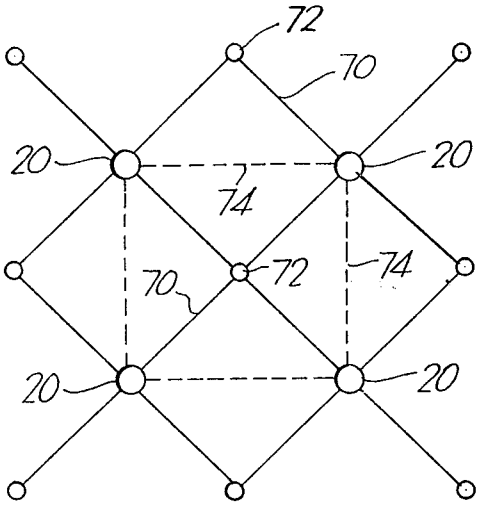
FIG. 6 schematically illustrates an alternative rectangular array of horizontal tunnels on the earth's surface interconnected by vertical drill holes, for use in the practice of an alternative hydrocarbon exploitation technique according to the present invention.

FIG. 6 illustrates a rectangular grid comparable to the hexagonal grid of FIG. 4 but in which four instead of six horizontal tunnels 70 extend radially outwardly from each of the central shafts 20 at angles of substantially 90° to one another. Drill holes 72 are located to intersect tunnels 70 at equal distances from the shaft 20. A grid can thus be established in which the drill holes 72 serve as many as four different shafts 20.

Since the electromagnetic field generated by only four turns will be relatively weak midway between the turn locations, additional turns can optionally be provided between adjacent shafts 20 as indicated by broken lines 74 which map the required horizontal tunnel locations. Note that these additional turns require no additional vertical drilling for their location but only two additional horizontal tunnels per turn. This grid design indicates the desirability of having several quasi-toroidal envelopes operating simultaneously.

Figure 7:
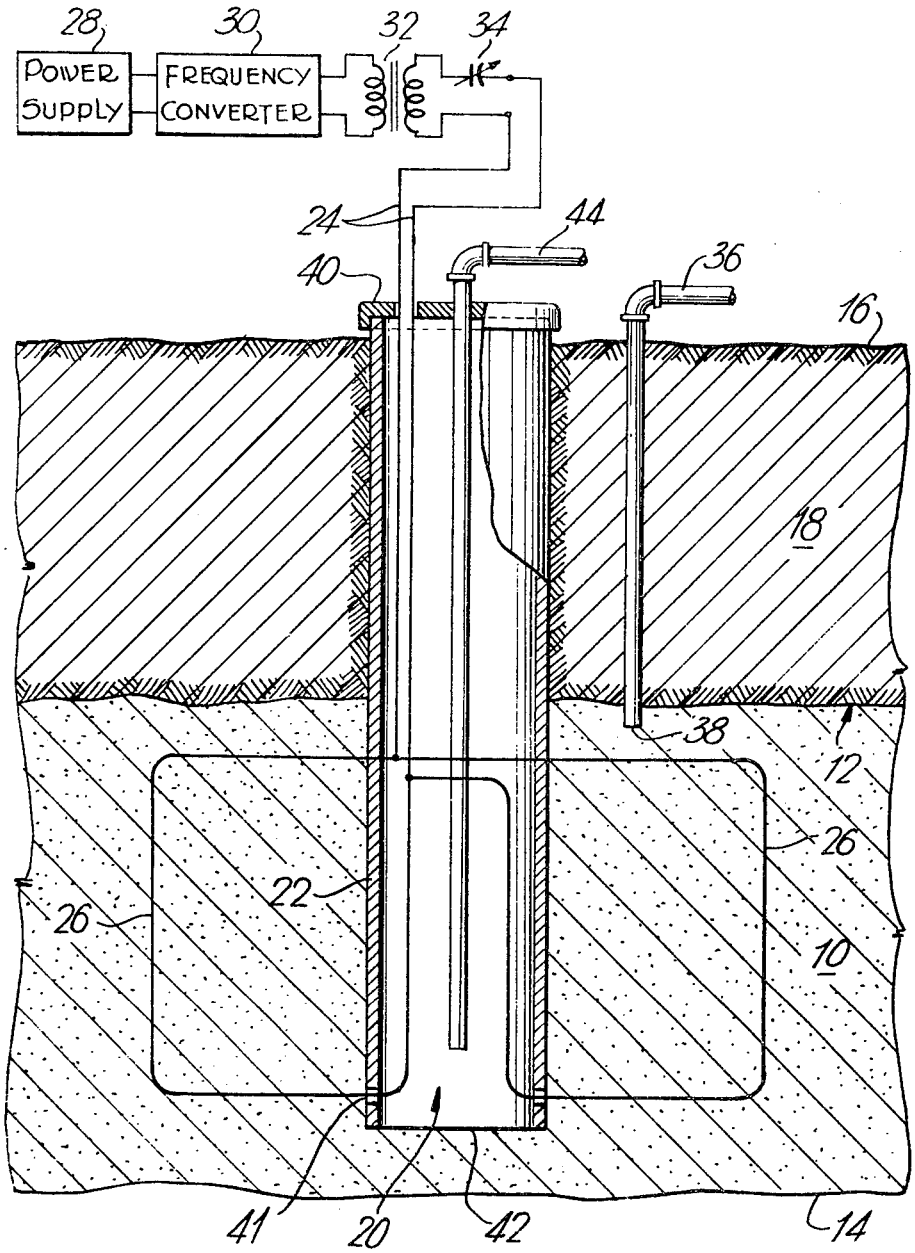
FIG. 7 illustrates a possible application of the teachings of the present invention to the heating of bituminous sands or oil shales.

In FIG. 7, a schematic illustration of structure suitable for heating of bituminous sands or oil shales is illustrated. For simplicity, only the innermost quasi-toroidal conductor configuration is illustrated, but the description to follow can be applied *mutatis mutandis* to outer quasi-toroidal envelopes.

An oil shale or bituminous sand deposit 10 is shown having an upper boundary 12 and a lower boundary 14. The formation 10 is separated from the earth's surface 16 by an overburden layer 18.

A central shaft generally indicated as 20 is provided from the surface to the bottom or a point near the bottom of the oil shale formation 10. For structural strength and sealing of the shaft, the shaft walls are generally provided with an annular concrete reinforcing layer 22 and the shaft is capped by a conventional well-cap 40.

Electrical conductors 24 extend from the surface power supply and into the shaft 20 for connection to rectangular electric induction coil 26. This rectangular coil 26 extends outwardly from the shaft 20 to surround an annular quasi-toroidal volume of the oil shale formation 10. Electricity is supplied to the conductors 24 from a power supply 28 (e.g. a generator driven by a turbine which may be powered by a portion of the extracted hydrocarbons), whose output may optionally be passed through a frequency converter 30, a transformer 32, or both, depending upon the desired operating parameters for the system and upon the frequency and voltage at which the output from power supply 28 is available. A series-connected tuning capacitor 34 is also provided to resonate the circuit so as to facilitate maximum energy transfer to the volume of oil shale encompassed by the induction coil 26.

An injection pipe 36 may optionally be provided for injecting water into the hot formation for the purpose of generating steam when hydrocarbon extraction has been substantially completed, or for injecting gas under pressure into the formation to facilitate extraction of the hydrocarbons, or may be used to inject catalysts into the formation to facilitate cracking of residual coke after volatile fractions have been extracted via suitable communicating holes 41 in the shaft lining and via extraction pipe 44. (The particular extraction techniques employed are at the option of the user and the present invention is confined to the heating technique per se.) Note that the lower end 38 of the pipe is located just above and outside the induction coil 26, since if the pipe 36 were made of metal and the pipe penetrated the volume encompassed by induction coil 26, the result would be the undue absorption of energy by the pipe 36 within the heated volume with attendant risk of damage to the pipe, burning of adjacent kerogen, etc. One or more pipes 36 may be provided as required, and instead of being located in separate drill holes, could conceivably be provided within the shaft 20 and directed radially outwards through suitable openings in the concrete layer 22 into the interior of the formation.

Alternating current is passed through the coil 26 at a frequency, voltage and amperage sufficient to heat the selected portion of the deposit within the annular quasi-toroidal envelope formed by the induction coil 26 to a desired temperature at which the method of extraction selected by the user is implemented.

Variations and modifications in the above-described specific techniques and configurations will occur to those skilled in the art. The present invention is not to be restricted thereby but is to be afforded the full scope defined by the appended claims.

What is claimed is:

1. A method of heating hydrocarbons in situ in a selected portion of an underground hydrocarbon deposit such as bituminous and or oil shale, comprising forming a quasi-toroidal conductor arrangement in the deposit substantially to envelope the said selected portion, and applying alternating current of selected voltage, amperage and frequency to the conductor arrangement to heat the selected portion by induction heating to a selected temperature.

2. A method as defined in claim 1, comprising forming within the deposit a second quasi-toroidal conductor arrangement whose inner radius is substantially the outer radius of the first-mentioned quasi-toroidal conductor arrangement, and applying alternating current of selected voltage, amperage and frequency to the second conductor arrangement to heat hydrocarbons therein to a selected temperature.

3. A method as defined in claim 2, wherein the ratio of the outer radius to the inner radius of each said quasi-toroidal conductor arrangement lies in the range 2:1 to 10:1.

4. A method as defined in claim 2, wherein the ratio of the outer radius to the inner radius of each and said quasi-toroidal conductor arrangement is of the order of 5:1.

5. A method as defined in claim 2, wherein the individual turns of each said quasi-toroidal conductor arrangement are of interrupted rectangular configuration.

6. A method as defined in claim 5, wherein each said quasi-toroidal conductor arrangement comprises six turns whose outermost conductive portions lie substantially on the apexes of a regular hexagon.

7. A method as defined in claim 1, wherein the individual coils of the quasi-toroidal conductor arrangement are of interrupted rectangular configuration.

8. A method as defined in claim 7, wherein the quasi-toroidal conductor arrangement comprises six turns whose outermost conductive portions lie substantially on the apexes of a regular hexagon.

* * * * *